United States Patent [19]

Welp

[11] Patent Number: 4,465,243

[45] Date of Patent: Aug. 14, 1984

[54] METHOD FOR THE SHAFTLESS WINDING OF A WEB

[75] Inventor: Ewald G. Welp, Erkrath, Fed. Rep. of Germany

[73] Assignee: Jagenberg AG, Dusseldorf, Fed. Rep. of Germany

[21] Appl. No.: 374,569

[22] Filed: May 3, 1982

[30] Foreign Application Priority Data

May 27, 1981 [DE] Fed. Rep. of Germany ..... 3121039

[51] Int. Cl.[3] ..... B65H 17/12

[52] U.S. Cl. ..... 242/66

[58] Field of Search ..... 242/65, 55, 66, 67.5, 242/67.1 R

[56] References Cited

U.S. PATENT DOCUMENTS

| | | | |
|---|---|---|---|
| 3,306,547 | 2/1967 | Reid et al. | 242/66 |
| 3,346,209 | 10/1967 | Cronin | 242/66 |
| 4,128,213 | 12/1978 | Komulainen | 242/66 |

*Primary Examiner*—John Petrakes

*Attorney, Agent, or Firm*—Sprung Horn Kramer & Woods

[57] ABSTRACT

The invention relates to a method for the shaftless winding of a web on two support rolls of different diameters, the smaller-diameter support roll having its axis in a horizontal plane above or below the horizontal plane in which the larger-diameter support roll has its axis. Specific pivot angles of the small-diameter support roll relative to the large-diameter support roll are employed in order to make the web-roll density more uniform over the diameter of the web roll and to decrease or increase said density as required.

5 Claims, 2 Drawing Figures

METHOD FOR THE SHAFTLESS WINDING OF A WEB

BACKGROUND OF THE INVENTION

It is known that the density of a web roll riding on two parallel support rolls can be controlled during the winding operation by distributing the weight of the web roll among the support rolls. To this end, support rolls of the same diameter are located in different horizontal planes, or support rolls of different diameters are employed. It is further known that when the web roll is wound on the smaller-diameter roll, a more tightly wound, or denser, web roll is obtained than when it is wound on the larger-diameter support roll.

Even though these facts have been known for tens of years, to this day no fully satisfactory winding technique has been developed. In an attempt to overcome the drawback that the inner layers of the web roll are radially compressed and deformed in a starlike manner by the outer layers as the web builds up on the roll, provision has been made for a high roll density at the start of the winding operation. However, this approach entails an excessively high roll density in the outer layers of the web roll, which results in creases, ruptures and tears. To overcome these drawbacks, web rolls have been wound to a smaller diameter, with the density of the roll then being at a tolerable level even in the outer layers. Moreover, it has been found that in the unwinding of a web accuracy-related problems would arise in processing the web at the station located downstream of the roll. In the case of a sheet cutter, it has proved impossible to cut the sheet to the exact size required. It has been found that this is due to varying web tension. Measurements of the web-roll density over the entire diameter of the roll have shown that the density fluctuates greatly about a mean value.

SUMMARY OF THE INVENTION

The object of the invention is to provide a method for the shaftless winding of a web on two support rolls which yields better results. More particularly, it is sought to produce a web roll of uniform density throughout its diameter and to prevent star formation.

In accordance with the invention, this object is accomplished, in a method for the shaftless winding of a web on two support rolls having different diameters, and more particularly having a diameter ratio of over 1.5, of which the smaller-diameter support roll has its axis in a horizontal plane that is above or below the horizontal plane in which the larger-diameter support roll has its axis, in that as a function of a desired maximum web-roll diameter $D_{Pmax}$ the maximum pivot angle $\alpha_o$ for the small-diameter support roll relative to the large-diameter support roll is set, at least at the start at the winding operation, at $$\alpha_o = +(\alpha_{max} - \beta_{max})$$

for a loosely wound, or low-density, web roll and at $$\alpha_o = -\arctan\left[\frac{1}{\tan\beta_{max}}\left(\frac{D_1 + 2a + D_2}{\cos\beta_{max}(D_1 + D_{pmax})} - 1\right)\right]$$

for a tightly wound, or high-density, web roll, where $\alpha_{max}$ = 80 to 90°, and $$\beta_{max} = \arccos\left(1 + \frac{A - D_{pmax} \times B}{C + D_{pmax} \times E}\right),$$

with $A = 2\,a\,(a + D_2)$ $B = 2\,(a = D_2)$ $C = D_1\,(D_1 2a + D_2)$ $E = D_1 + 2a + D_2$ $a \cong$ support-roll clearance With the method of the invention for the two winding densities, web rolls are obtained whose density increases less rapidly with the diameter of the roll than with conventional winding methods. This amounts to a reduction of the density level overall and hence means reduced stresses on the web. The likelihood of star formation in the inner region as a result of tightly wound outer layers and more loosely wound inner layers is minimized if not eliminated. The invention makes it possible to wind large-diameter web rolls without exceeding the maximum permissible web-roll density. The density level of the roll being wound can be raised or lowered as required to improve the web-roll quality and to prevent damage to the web on the roll.

Satisfactory results have been obtained with this method when the pivot angle $\alpha_o$ initially set was maintained throughout the winding operation. However, it is likely that further improvements can be achieved if the pivot angle $\alpha$ and/or the support-roll clearance a is or are varied on the basis of a predetermined program. To keep the relationships as nearly independent of the web tension as possible, it is contemplated that when a less dense roll is to be wound the web be wrapped around the support roll having the larger diameter.

While with the web rolls used in practice both support rolls are driven, with the support roll around which the web is wrapped lagging and the other support roll leading, in accordance with a further feature of the invention it is not necessary to drive both support rolls when one of them carries most of the weight of the web roll. In this case it will suffice to drive the more heavily loaded support roll.

BRIEF DESCRIPTION OF THE DRAWINGS

The invention will now be described in greater detail with reference to the accompanying drawing, wherein.

DETAILED DESCRIPTION OF THE INVENTION

Figure 1:
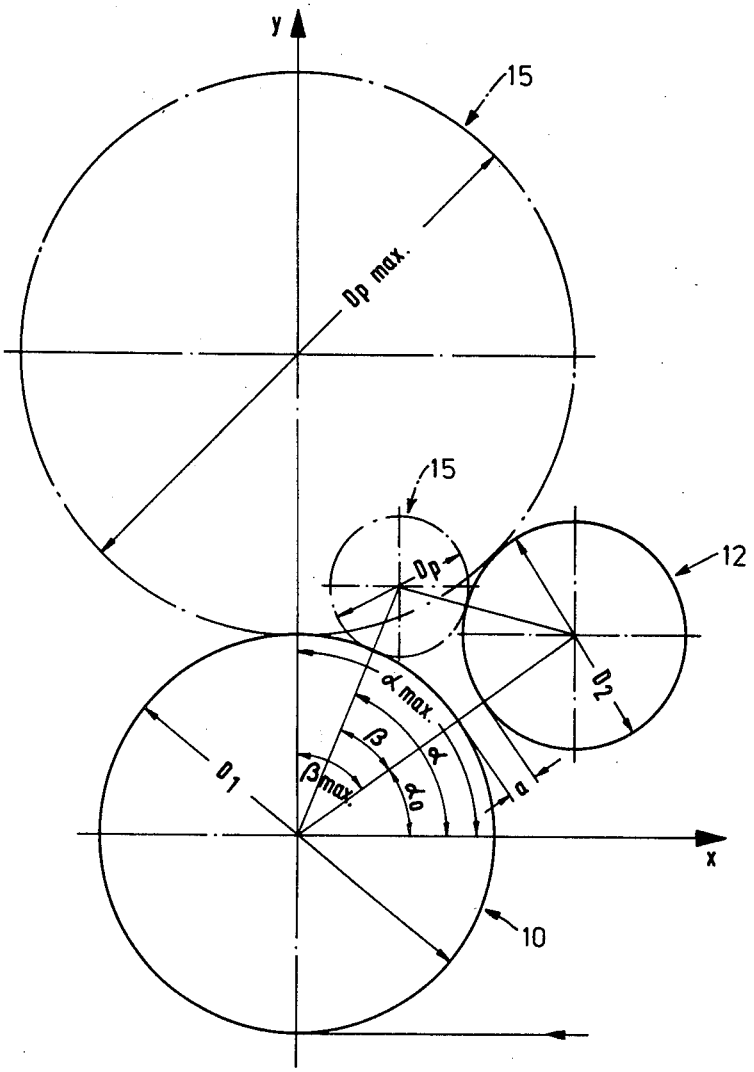
FIG. 1 diagrammatically shows a winder set for winding a less dense web roll, and FIG. 2 diagrammatically shows a winder set for winding a dense roll.
Figure 2:
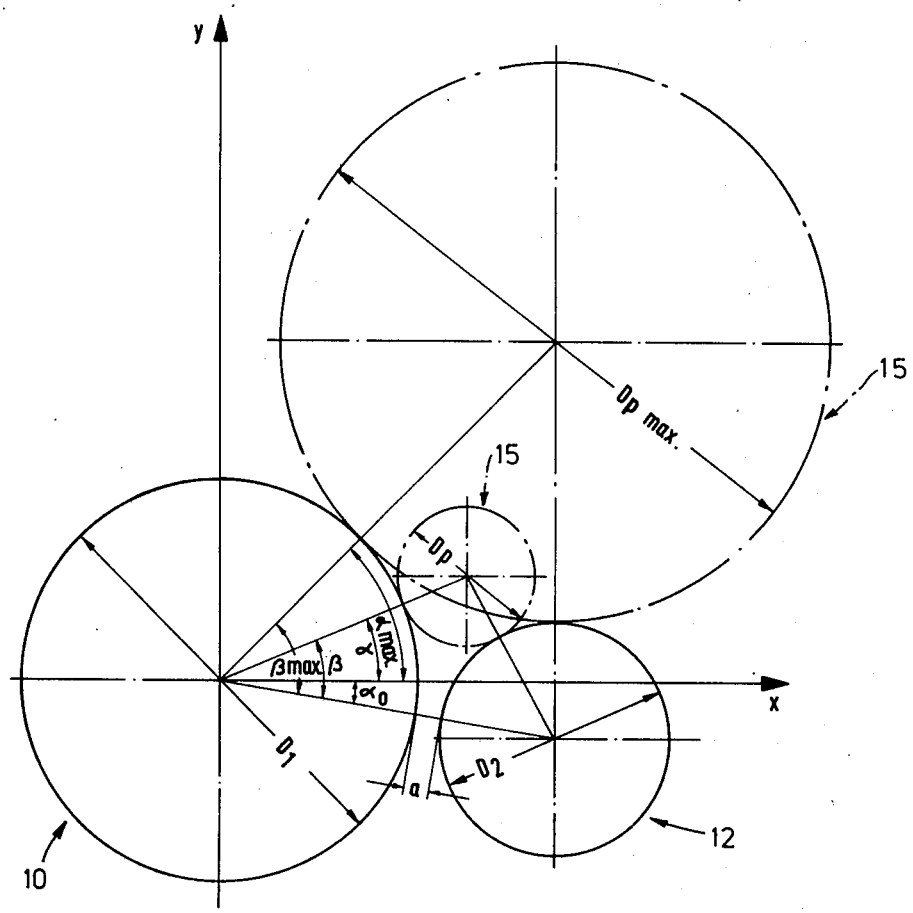

In FIGS. 1 and 2 there is shown a large diameter support roll 10 having a diameter $D_1$, a small diameter support roll 12 having a diameter $D_2$ and a roll 15 being wound while supported by rolls 10 and 12. Roll 15 has an initially small diameter $D_p$ which grows to a diameter $D_{pmax}$.

An angle $\alpha$ is between the horizontal axis x and the line joining the center of the larger support roll 10 and the center of $D_p$ of roll 15. An angle $\beta$ is between the line joining the centers of $D_1$ and $D_2$ and the line joining the centers of $D_1$ and $D_p$. An angle $\alpha_{max}$ is between the horizontal x and the line joining the centers of $D_1$ and $D_{pmax}$. A pivot angle $\alpha_o$ is defined as $\alpha-\beta$ and an angle $\beta_{max}$ is defined as $\alpha_{max}-\alpha_o$.

Vertical axis y phases through the centers of $D_{pmax}$ and $D_1$ and intersects the horizontal axis x at the center of $D_1$.

In designing a between rolls 10 and 12 winder, the support-roll clearance a is determined first. The smallest diameter $D_2$ of the smaller diameter support roll 12 depends on the load which this roll 12 has to carry. The requirements which this roll 12 must meet are: Low bending deformation when loaded with the web roll 15; adequate resistance to fracture under static and dynamic stresses; no critical turning and bending frequencies.

In selecting the diameter $D_1$ of the larger-diameter roll 10, the desired web-roll 15 density must be taken into consideration. A lower-density web roll 15 can be obtained on large-diameter support rolls than on small-diameter support rolls.

Once the diameter ratio has been determined, the pivot angle $\alpha_o$ can be calculated by means of the above formula as a function of the desired final web-roll diameter. Since for safety reasons winding usually will not be continued until the web roll 15 is on the very top of the support roll 10 for winding a less dense web roll (see FIG. 1) and 12 for winding a dense roll (see FIG. 2), a value smaller than 90° will be assumed for $\alpha_{max}$. Good results have been obtained with an angle $\alpha_{max}$ of 85°.

It has been found that a low-density web roll will be obtained especially when the nip-induced winding tension is produced primarily by a nip and primarily on the larger-diameter support roll 10. These conditions are satisfied when the axis of the web roll 15 during the winding operations moves only through a small angle about the axis of the larger-diameter support roll 10 and the initial pivot angle $\alpha_o$ is large. This can be secured with a large diameter ratio $D_1/D_2$. At the same time, a more uniform web-roll density is obtained over the diameter of the web roll 15. A diameter ratio of 1.7 has been found to be satisfactory.

One satisfactory system employs a large roll 850 mm in diameter, a small roll 500 mm in diameter with the web-roll wound to a maximum diameter of 1300 mm. The support roll clearance a is 15 mm. The angle $\alpha$ is 82.4° and $\beta$ is 56.4° for a pivot angle $\alpha_o$ of 26°.

It will be appreciated that the instant specification and claims are set forth by way of illustration and not of limitation, and that various modifications and changes may be made without departing from the spirit and scope of the present invention.

What is claimed is:

1. In the shaftless winding of a web on two support rolls of different diameter and having parallel axes, the improvement which comprises employing support rolls whose axes are in different horizontal planes and wherein at the start of the winding operation as a function of a desired maximum web-roll diameter $D_p$max, the maximum pivot angle $\alpha_o$ for the small diameter support roll relative to the large-diameter support roll is set at $$\alpha_o = +(\alpha_{max} - \beta_{max})$$

for a loosely wound, or low-density, web roll and at $$\alpha_o = -\arctan\left[\frac{1}{\tan\beta_{max}}\left(\frac{D_1 + 2a + D_2}{\cos\beta_{max}(D_1 + D_{pmax})} - 1\right)\right]$$

for a tightly wound, or high-density, web roll, where $$\alpha_{max} = 80 \text{ to } 90°, \text{ and}$$

$$\beta_{max} = \arccos\left(1 + \frac{A - D_{pmax} \times B}{C + D_{pmax} \times E}\right),$$

with $A = 2\,a\,(a + D_2)$ $B = 2\,(a + D_2)$ $C = D_1\,(D_1 + 2a + D_2)$ $E = D_1 + 2a + D_2$

*a≅support-roll clearance.*

2. A method according to claim 1, wherein the diameter of the larger support roll is at least 1.5 times the diameter of the smaller support roll.

3. A method according to claim 1, wherein the pivot angle $\alpha_o$ is maintained throughout the winding operation.

4. A method according to claim 1, wherein the web is wrapped around the larger-diameter support roll, thereby to obtain a lower-density web roll.

5. A method according to claim 1, wherein the support rolls carry different loads, only the more heavily loaded roll being driven.

* * * * *